US006263882B1

(12) United States Patent
Chehab et al.

(10) Patent No.: US 6,263,882 B1
(45) Date of Patent: Jul. 24, 2001

(54) METHOD OF AND APPARATUS FOR MAKING FILTER MOUTHPIECES FOR ROD-SHAPED ARTICLES OF THE TOBACCO PROCESSING INDUSTRY

(75) Inventors: Firdausia Chehab, Hamburg; Stefan Fietkau, Westerau; Franz-Peter Arnold, Hamburg, all of (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/267,385

(22) Filed: Mar. 15, 1999

(30) Foreign Application Priority Data

Mar. 13, 1998 (DE) ..... 198 11 014

(51) Int. Cl.[7] ..... A24C 5/18; B31C 13/00; D02G 1/00; D01D 11/02

(52) U.S. Cl. ..... 131/84.1; 131/88; 493/44; 493/39; 28/219; 28/282; 28/283; 28/240; 28/244; 28/246

(58) Field of Search ..... 131/88, 84.1; 493/44, 493/39; 28/240, 282, 283, 219, 244, 246

(56) References Cited

U.S. PATENT DOCUMENTS

| | | |
|---|---|---|
| 2,774,680 | 12/1956 | Hackney et al. . |
| 2,778,403 | 1/1957 | Hackney et al. . |
| 2,805,671 | 9/1957 | Hackney et al. . |
| 2,820,432 | 1/1958 | Hackney et al. . |
| 3,566,451 | 3/1971 | Weigand . |
| 3,974,007 | 8/1976 | Greve . |
| 4,259,769 | 4/1981 | Greve et al. . |
| 4,721,119 | 1/1988 | Ludszeweit et al. . |
| 5,135,008 | 8/1992 | Oesterling et al. . |
| 5,429,575 | 7/1995 | Armour et al. . |
| 5,590,449 | 1/1997 | Chehab et al. . |

FOREIGN PATENT DOCUMENTS

| | | |
|---|---|---|
| 1 109 940 | 2/1956 | (FR) . |
| 793114 | 4/1958 | (GB) . |
| 2 018 309 | 11/1979 | (GB) . |
| 2 263 384 | 7/1993 | (GB) . |

*Primary Examiner*—James Derrington
*Assistant Examiner*—Dionne A. Walls
(74) *Attorney, Agent, or Firm*—Venable; Robert Kinberg; Catherine M. Voorhees

(57) ABSTRACT

A tow of filamentary filter material for tobacco smoke which is to be converted into a rod-like filler of a filter rod is conveyed along an elongated path first through a stretching or tensioning zone where the filaments are stretched and the tow is converted into a relatively wide flat web, thereupon along a relaxing portion of the path wherein the tensioning action upon the filaments is reduced, thereupon along a third portion wherein at least one side of the running web is contacted by droplets of an atomized plasticizer, and thereafter along a fourth portion of the path wherein the web is gathered by reducing its width so that it more closely resembles a rod which is thereupon draped into a web of cigarette paper or other suitable wrapping material. A wind tunnel surrounds at least one portion of the path to confine at least one stream of air which is caused to flow in the direction of advancement of the tow. A tunnel can surround the stretching zone, the relaxing and/or the fourth portion of the path.

26 Claims, 2 Drawing Sheets

METHOD OF AND APPARATUS FOR MAKING FILTER MOUTHPIECES FOR ROD-SHAPED ARTICLES OF THE TOBACCO PROCESSING INDUSTRY

CROSS-REFERENCE TO RELATED CASES

This application claims the priority of German patent application Ser. No. 198 11 014.6 filed Mar. 13, 1998. The disclosure of the German patent application, as well as that of each US and foreign patent and patent application mentioned in the specification of the present application, is incorporated herein by reference.

BACKGROUND OF THE INVENTION

The invention relates to improvements in methods of and in apparatus for the making of filter plugs or filter mouthpieces for cigarettes or other rod-shaped articles of the tobacco processing industry. More particularly, the invention relates to improvements in methods of and in apparatus for converting a continuous tow of originally crimped filamentary filter material for tobacco smoke (such as cellulose acetate fibers) into a rod-like filler which is ready to be draped into a web of cigarette paper or other suitable wrapping material to form a continuous filter rod ready to be subdivided into filter rod sections or filter mouthpieces (plugs) of unit length or multiple unit length. Filter mouthpieces of unit or multiple unit length can be fed into the magazine of a so-called tipping machine wherein the filter mouthpieces are connected (normally by so-called uniting bands of artificial cork or the like) with plain cigarettes of unit length of multiple unit length to form therewith filter cigarettes of unit length or multiple unit length.

In accordance with the presently prevailing practice, a filter tow is drawn from a bale and is thereupon subjected to a series of special treatments including spreading or banding and stretching of its filaments to thus convert the tow into a flat and relatively wide web or strip of parallel or nearly parallel filaments, and thereupon contacting the web with a suitable plasticizer (such as triacetin) to bond portions of neighboring filaments to each other. This ensures that the filaments in a finished filter mouth-piece define a maze of passages for the flow of tobacco smoke and the mouthpiece can intercept a high percentage of tar, condensate and certain other ingredients of tobacco smoke before the smoke reaches the smoker's mouth. The plasticizer applying station is followed by a so-called gathering or collecting station where the width of the web is reduced so that the thus treated tow resembles or again resembles a rod-like mass of filaments ready to be draped into cigarette paper or the like.

An important requirement for the making of satisfactory filter mouthpieces is to ensure that the homogeneousness of the filler in each of a short or long series of successively formed filter mouthpieces fluctuates very little or not at all, and that such homogeneousness matches or very closely approximates an optimum value. Furthermore, each unit length of the tow must yield a high number of fillers for filter mouthpieces. As a rule, the making of lightweight filter mouthpieces which, in spite of the relatively small quantity of filamentary filter material therein, constitute satisfactory barriers to the penetration of tar and condensate into a smoker's mouth renders it even more important and necessary to enhance the homogeneousness of successive increments of the treated tow which is ready to be converted into the filler of a filter rod. Another desirable characteristic of a satisfactory filter mouthpiece is a rather pronounced resistance to the flow of tobacco smoke therethrough.

U.S. Pat. No. 5,590,449 discloses an apparatus wherein so-called banding nozzles are utilized to separate the filaments in successive increments of the running tow ahead of the so-called stretching zone in which the conversion of the tow into a relatively wide and flat strip or web of parallel or substantially parallel filaments is completed. Such web is thereupon advanced through the plasticizing station and thereafter through the gathering station prior to admission into the filter rod forming zone. The introduction of successive increments of the gathered web into the rod forming station can be preceded by a treatment with a stream of compressed air and the passage through the so-called gathering horn.

Reference may also be had to U.S. Pat. No. 3,974,007 which discloses a method of and an apparatus for the formation of filter rod sections, and to U.S. Pat. No. 4,721,119 which discloses a rod making machine wherein a web of cigarette paper or the like can be draped around a rod-like filler of fibrous material of the tobacco processing industry.

It has been found that, in many instances, spreading, stretching and other presently known treatments of a tow of filamentary filter material for tobacco smoke cannot invariably and reliably ensure the elimination of all undesirable accumulations (such as clumps) of non-separated filaments ahead of the wrapping station. This results in the making of filter mouthpieces exhibiting an unacceptable resistance to the flow of tobacco smoke and/or other undesirable characteristics of the ultimate products.

Furthermore, the path for the advancement of filamentary filter material from the source of tow (such as the aforementioned bale) to the wrapping station is likely to contain filaments which became separated from the main body of the tow that is being advanced through the banding, stretching, plasticizing and gathering stations. The presence of loose filaments of cellulose acetate in the path which is provided for the advancement of the tow toward the wrapping station and/or in the atmosphere surrounding a production line including one or more filter rod making machines, one or more filter tipping machines and normally one or more additional (such as packing, cellophaning and other) machines is highly undesirable for a number of reasons.

OBJECTS OF THE INVENTION

An object of the invention is to provide a method of converting a tow of filamentary filter material for tobacco smoke which can be resorted to for the making of highly satisfactory filter mouthpieces regardless of the speed at which the tow is being drawn from the source and transported toward the wrapping station.

Another object of the invention is to provide a method which renders it possible to reliably remove separated filaments of fibrous filter material for tobacco smoke from the path for the tow between the source and the wrapping station.

A further object of the invention is to provide a method which renders it possible to convert the tow into a rod-like filler exhibiting a homogeneousness and/or other desirable characteristics superior to those of fillers which are obtained in accordance with heretofore known methods.

An additional object of the invention is to provide a novel and improved apparatus for the practice of the above outlined method.

Still another object of the invention is to provide the apparatus with novel and improved stretching, gathering and other means for treating the filaments of the tow on their way from the source of tow toward the wrapping station.

A further object of the invention is to provide the above outlined apparatus with novel and improved means for removing segregated filaments from the path of the bulk of filaments forming a tow through various processing stations.

Another object of the invention is to provide an apparatus which is designed to prevent atmospheric air along the path of the tow from adversely influencing the treatment of the tow at one or more stations between the source of tow and the wrapping station where the processed tow is confined in a continuous wrapper of cigarette paper or other suitable wrapping material.

An additional object of the invention is to provide an apparatus which can automatically expel or otherwise evacuate segregated filaments of fibrous filter material for tobacco smoke from the path for the tow toward the wrapping station.

Still another object of the invention is to provide an apparatus which can be designed to take up a relatively small amount of space in a production line for the making of filter cigarettes or other filter tipped rod-shaped articles of the tobacco processing industry.

A further object of the invention is to provide a production line, particularly for the mass production of filter cigarettes, which embodies one or more apparatus for the treatment and processing of tows of filamentary filter material for tobacco smoke in the above outlined manner.

SUMMARY OF THE INVENTION

One feature of the present invention resides in the provision of a method of converting a tow of stretchable filamentary filter material for tobacco smoke into a rod-like filler which can be draped into a web of cigarette paper or the like to form a filter rod ready to be subdivided into filter rod sections or filter mouthpieces of unit length or multiple unit length. The method comprises the steps of advancing a continuous tow of filamentary filter material from a source (e.g., a bale of compacted tow) in a predetermined direction along a predetermined elongated path, stretching the filaments of the advancing tow in a first portion of the path, contacting the thus stretched filaments of the advancing tow with a suitable plasticizer (e.g., triacetin) in a second portion of the path downstream of the first portion, thereupon gathering or collecting the advancing tow in a third portion of the path, and subjecting the advancing tow to the action of a gaseous fluid (such as air) in at least one of the aforementioned portions of the predetermined path including conveying the fluid in the predetermined direction.

The stretching step preferably includes converting the tow into a relatively flat and relatively wide web of filamentary filter material, and the contacting step preferably includes spraying the plasticizer onto the web. The gathering step preferably includes reducing the width of the web downstream of the second portion of the path (as seen in the predetermined direction).

The advancing step can include advancing the tow at a predetermined speed at least in the at least one portion of the path, and the subjecting step (and more specifically the conveying step) can comprise conveying the gaseous fluid in the predetermined direction at a speed which at least approximates, which matches or which exceeds the predetermined speed.

As already mentioned hereinbefore, the stretching step can include converting the tow into a relatively flat and relatively wide web, i.e., into a body having a first side and a second side, and the fluid conveying step of such method can comprise contacting the two sides of the web with discrete flows of gaseous fluid while the web is being advanced in the at least one portion of the predetermined path.

The at least one portion is or can be the first portion or the third portion of the predetermined path.

The at least one portion of the predetermined path has an upstream end and a downstream end (as seen in the predetermined direction), and the fluid conveying step can include drawing the gaseous fluid from the upstream end toward the downstream end of the at least one portion of the path; this can be readily achieved by setting up at least one suction generating device at the downstream end of the at least one portion of the predetermined path.

It is often desirable to resort to a further step of relaxing the stretching of the aforementioned web (which is obtained as a result of stretching in the first portion of the path) in a fourth portion between the first and second portions of the path. The fluid conveying step of such method can include contacting at least one side of the web with gaseous fluid in the fourth portion of the path.

Another feature of the invention resides in the provision of an apparatus for converting a tow of stretchable filamentary filter material for tobacco smoke into a rod like filler. The improved apparatus comprises means for advancing a continuous tow of filamentary filter material from a source (such as the aforementioned bale) in a predetermined direction along a predetermined path, means for stretching the filaments of the advancing tow in a first portion of the path, means for contacting the advancing tow of stretched filamentary filter material with a plasticizer in a second portion of the path downstream of the first portion, means for thereupon gathering or collecting the advancing tow in a third portion of the path, and means for subjecting the tow to the action of a flowing gaseous fluid in at least one of the aforementioned portions of the predetermined path, including means for inducing the flow of gaseous fluid in the predetermined direction.

The stretching means can include means for converting the tow into a relatively flat and relatively wide web of filamentary filter material, and the contacting means can include means for spraying the plasticizer onto the web. The gathering means can include means for reducing the width of the web downstream of the second portion of the path (as seen in the predetermined direction).

The gaseous fluid is or can be atmospheric air.

The means for subjecting the tow to the action of a flowing gaseous fluid preferably further includes a wind tunnel which at least partially surrounds the tow in the at least one portion of the predetermined path. The fluid flow inducing means can include means for drawing gaseous fluid from the upstream end toward the downstream end of the wind tunnel (as seen in the predetermined direction).

The advancing means can include means for conveying the tow at a predetermined speed, at least in the at least one portion of the predetermined path, and the means for drawing gaseous fluid can include means for imparting to the gaseous fluid a second speed which at least approximates, which matches or which exceeds the predetermined speed.

As already mentioned hereinbefore, the stretching means can include means for converting the tow into a web. The wind tunnel can include first and second sections each of which is adjacent a different side of the web in the at least one portion of the predetermined path. The flow inducing means of such apparatus can include suction generating means operatively connected to the downstream ends of the two sections of the wind tunnel.

If the at least one portion is the first portion of the predetermined path, and the means for subjecting the tow to the action of a flowing gaseous fluid comprises a wind tunnel which at least partially surrounds the first portion of the path, the fluid flow inducing means can include suction generating means connected to the downstream end of the wind tunnel.

If the at least one portion is the third portion of the predetermined path and if the means for subjecting the tow to the action of a flowing gaseous fluid further includes a wind tunnel which at least partially surrounds the tow in the third portion of the path, the fluid flow inducing means can include suction generating means operatively connected to the downstream end of such wind tunnel.

The means for subjecting the tow to the action of a flowing gaseous fluid can further comprise adjusting means for varying the rate of fluid flow through the wind tunnel. To this end, the wind tunnel has walls which at least partially surround the at least one portion of the predetermined path, and at least one such wall is adjustable, preferably substantially transversely of the predetermined direction, to thus vary the rate of fluid flow through the wind tunnel.

The discharge end of the wind tunnel can be designed to reverse the direction of fluid which has flown from the upstream end to the downstream end of such wind tunnel. For example, this wind tunnel can at least partially surround the first portion of the predetermined path.

The apparatus can further comprise means for relaxing the stretching of filamentary filter material of the tow in a fourth portion between the first and second portions of the predetermined path. If the means for subjecting the tow to the action of a flowing gaseous fluid further includes a wind tunnel, such wind tunnel can at least partially surround the filaments of the tow in the fourth portion of the predetermined path. The fluid flow inducing means can comprise means for admitting compressed gaseous fluid into the wind tunnel at the upstream end of such tunnel, and a suction generating device which is connected to the wind tunnel at the latter's downstream end.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
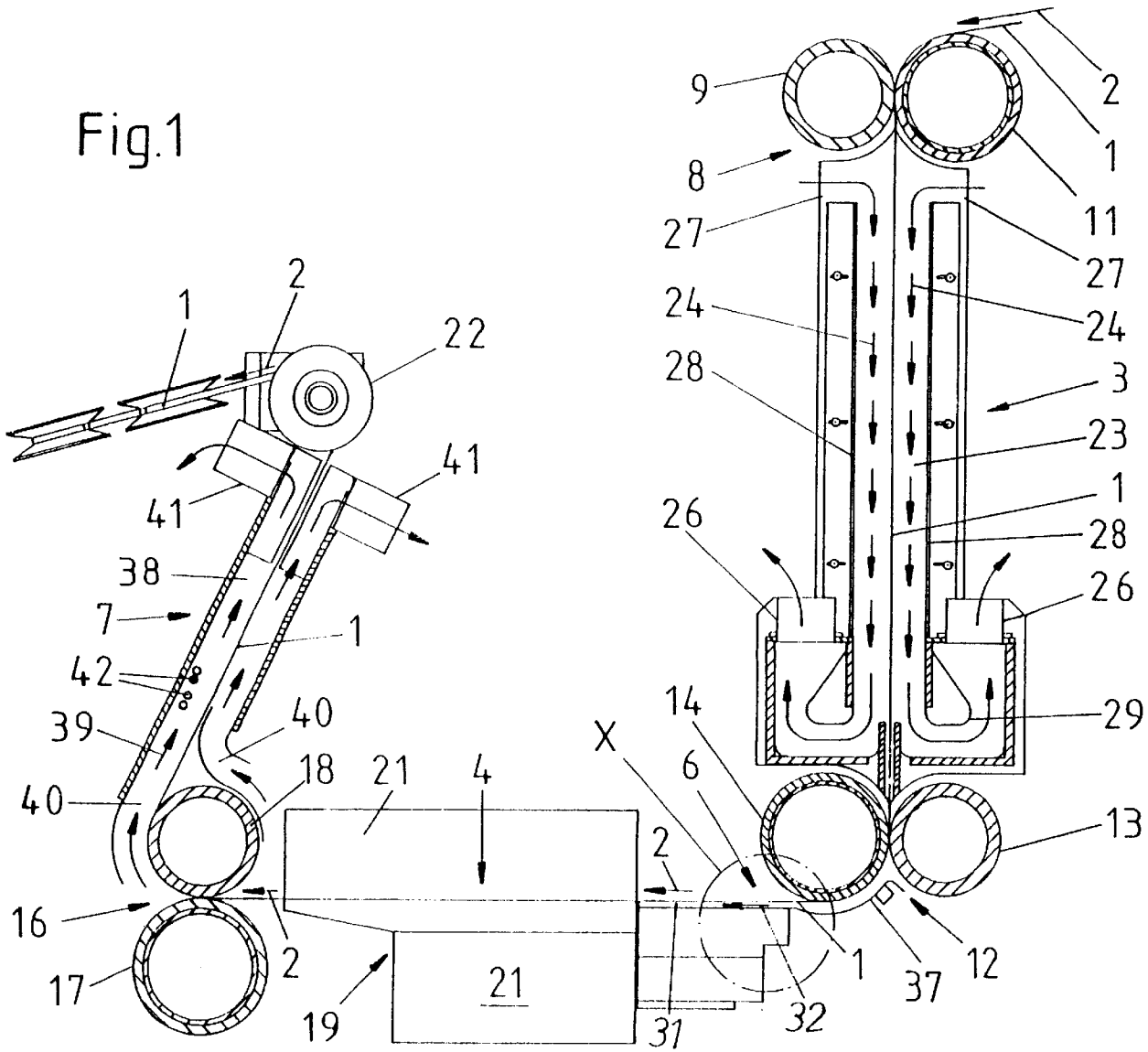
FIG. 1 is a schematic partly elevational and partly vertical sectional view of an apparatus which embodies one presently preferred form of the invention.

Referring first to FIG. 1, there is shown an apparatus which constitutes an improvement over and a further developent of the apparatus disclosed in U.S. Pat. No. 5,590,449. The improved apparatus is designed for the treatment of a tow 1 of filamentary filter material for tobacco smoke (such as cellulose acetate fibers) which is drawn from a bale and has passed one or more separating or banding nozzles of the type disclosed and shown, for example, in U.S. Pat. No. 3,974,007.

The apparatus of FIG. 1 defines for the tow an elongated substantially U-shaped path including a downwardly extending first portion 3 wherein the filaments of the tow are stretched between a first pair or set 8 of motor-driven rollers 9, 11 and a second motor-driven pair or set 12 of rollers 13, 14. A (substantially horizontal) second portion 4 of the path extends through a plasticizing station wherein the relatively wide flat web (converted tow 1) leaving the nip of the driven rollers 13, 14 is contacted with an atomized plasticizer (such as triacetin) to bond portions of neighboring filaments of the running web to each other. The thus treated running web thereupon enters an upwardly extending third portion 7 of the path wherein the relatively wide web is gathered (i.e., collected or condensed) to more closely resemble (or to again resemble) a rod-like filler which is ready to enter the aforementioned gathering horn (reference may be had to the aforementioned U.S. Pat. No. 3,974,007) and thereupon the wrapping mechanism (such as that shown and described in U.S. Pat. No. 3,974,007 or in U.S. Pat. No. 4,721,119) which drapes the filler into a web of cigarette paper or other suitable wrapping material. The resulting filter rod is ready to be subdivided into filter rod sections or mouthpieces of desired length ready for introduction into the magazine of a filter tipping machine, e.g., a machine of the type disclosed in U.S. Pat. No. 5,135,008.

A fourth portion of the path for the tow 1 (between the portions 3 and 4) can be provided to ensure a certain amount of relaxation of filaments which were stretched at 3 and are about to be contacted by droplets of plasticizer in the path portion 4.

The rollers 9, 11 of the pair 9 at the upstream end of the path portion 3 are driven by a first motor or by a first transmission (see the U.S. Pat. No. 3,974,007), and the rollers 13, 14 of the pair 12 are driven by a second motor or transmission at a peripheral speed which is higher than that of the rollers 9, 11 so that the elastic filaments of the converted tow 1 are adequately stretched on their way toward the path portion 6 (in direction indicated by the arrows 2).

A third pair (16) of motor-driven rollers 17, 18 is provided to advance the converted tow 1 (in the direction indicated by the arrows 2) through the (fourth and second) portions 6, 4 of the path for the tow. The peripheral speed of the rollers 17, 18 is less than that of the rollers 13, 14 to thus permit a certain relaxation (reduction of the stretch) of the filaments advancing past the instrumentalities in the path portions 6 and 4.

The apparatus 19 at the path portion 4 has two sections or units 21 designed to atomize the selected plasticizer and to spray droplets of atomized plasticizer against both sides of the flat and relatively wide web (converted tow 1) of filamentary filter material advancing from the nip of the rollers 13, 14 toward the nip of the rollers 17, 18.

The means for advancing the tow 1 along the substantially U-shaped path further comprises a motor-driven roller 22 which causes the filaments to travel from the nip of the rollers 17, 18 upwardly, through the path portion 7, and to be trained over the driven roller 22. The manner in which a suitable gathering unit can gradually reduce the width of the relatively wide web advancing beyond the nip of the rollers 17, 18 is fully disclosed in U.S. Pat. No. 5,590,449. This patent further discloses a presently preferred further treatment of the gathered web by a compressed air nozzle and a gathering horn prior to introduction of the thus obtained rod-like filler into the wrapping mechanism of the filter rod making machine.

In accordance with a feature of the invention, the improved apparatus comprises means for subjecting the tow 1 to the action of a flowing gaseous fluid (normally air) in at least one portion of the elongated path for the tow between the driven rollers 9, 11 and the driven roller 22. Such means includes means for inducing the flow of air in the direction which is indicated by the arrows 2.

The means for subjecting the tow 1 to the action of air during advancement of the tow in the first path portion 3 comprises a composite wind tunnel 23 which surrounds at least a major portion of the flat web between the driven rollers 9, 11 and 13, 14. The flow of air in the direction indicated by the arrows 24 (namely of two discrete streams, one along each side of the web (converted tow 1) in the path portion 3) is induced by a single suction generating device or by two discrete suction generating devices having suction intakes 26 connected to the downstream ends of the respective sections of the wind tunnel 23. Thus, the suction generating device including the intakes 26 compels two air streams to flow at the respective sides of the web of stretched filaments in the direction indicated by the arrows 24 from the intake (upper) ends 27 of the tunnel sections at the rollers 9, 11 toward and away from the discharge ends or downstream ends of the tunnel sections at the rollers 13, 14.

The speed (e.g., 10 meters per second) of each of the two air streams can approximate, match or exceed the speed (e.g., about 600 meters per minute) of the web from the nip of the rollers 9, 11 toward the nip of the rollers 13, 14.

The wind tunnel 23 includes upright walls 28 at least one of which is adjustable transversely of the direction indicated by the arrows 2 and 24 to thus select the exact rate of air flow along the sides of the web in the path portion 3. The outlets 29 of the two sections of the wind tunnel 23 (at the intakes 26 of the suction generating device or devices, e.g., one or more suction pumps or blowers) can be configurated in such a way that the flow of air is reversed (i.e., changed through approximately 180 degrees) immediately or closely upstream of the nip of the driven rollers 13, 14. This ensures reliable evacuation and interception of filaments which became separated from the bulk of the web advancing along the path portion 3 from the rollers 9, 11 toward the rollers 13, 14.

The walls 28 of the wind tunnel 23 can be adjustably mounted on a suitable frame by means of bolts or other suitable fasteners. To this end, the walls 28 can be provided with elongated slots (shown but not referenced in FIG. 1) which extend transversely of the direction of travel of the web of filaments and receive the shanks of the fasteners.

Figure 2:
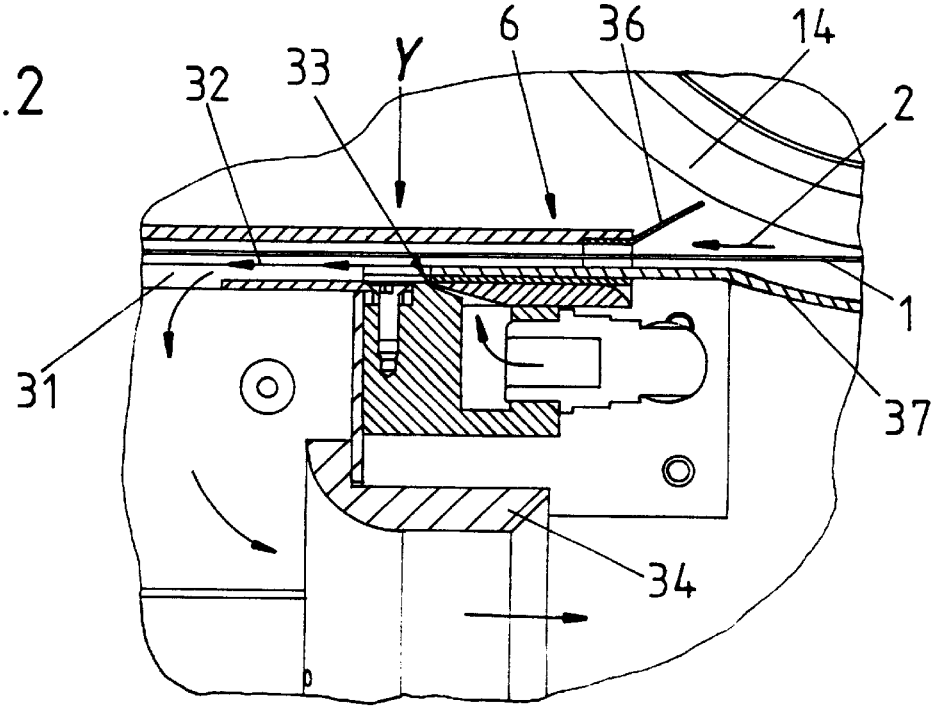
FIG. 2 is an enlarged vertical sectional view of a detail within the phantom-line circle X in FIG. 1.
Figure 3:
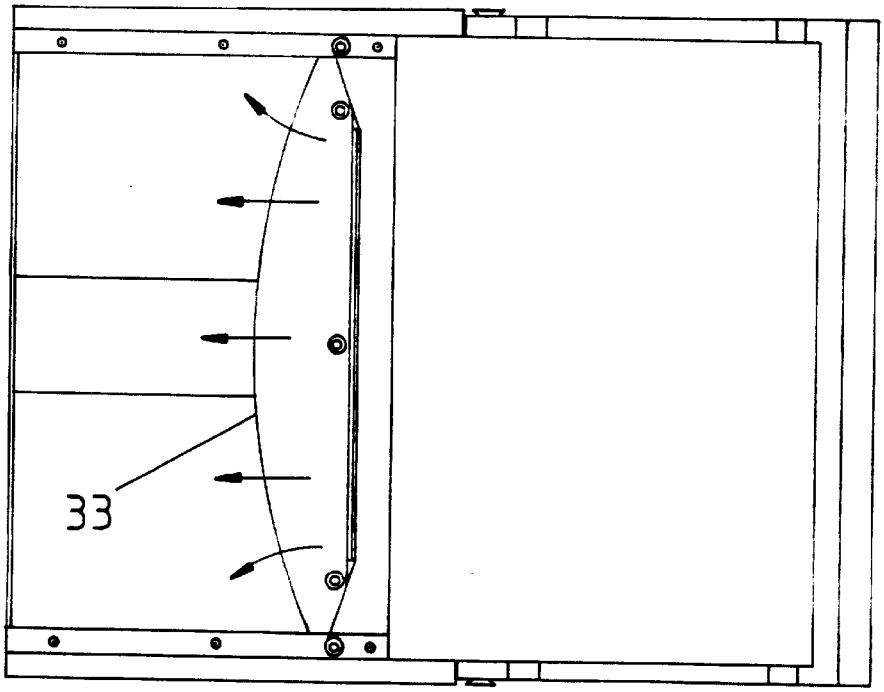
FIG. 3 is a plan view of the structure which is shown in FIG. 2.

FIGS. 2 and 3 show the means for establishing and influencing the flow of air in the direction of arrows 2 along one side of the web (converted tow 1) in the further portion (6) of the path between the path portions 3 and 4. A wind tunnel 31 causes a stream 32 of suction air to flow from a nozzle 33 at the upstream end of the tunnel 31 (above a plate-like guide 37 and below a plate-like flap 36 for the filaments) toward a suction generating device 34 having an intake end at the downstream end of the wind tunnel 31.

A third wind tunnel 38 is provided in the path portion 7 to guide two air streams 39 at opposite sides of the web advancing from the nip of the rollers 17, 18 toward the periphery of the driven roller 22. The upper ends 41 of the two sections of the tunnel 38 are oriented to deflect the ascending air streams 39 away from the path of the web toward the driven roller 22. Such upper ends can form part of the intake of a single suction generating device or of two discrete suction generating devices which compel the streams 39 to flow from the upstream end (at 40) toward the downstream end (at 22) of the wind tunnel 38.

The character 42 denotes rod-shaped ionizing devices, e.g., of the type known as EI-RD Tandem with a network portion known as Type EN-70, both distributed by the Firm HAUG of Federal Republic Germany. The purpose of the ionizing devices 42 is to relieve the filaments of the gathered web of electrostatic charges which could interfere with satisfactory treatment of the filaments downstream of the driven roller 22.

The beneficial influence of the air flows 24, 32 and 39 in the path portions 3, 6 and 7 is that the advancing filaments are not braked and/or otherwise adversely influenced by the surrounding air. On the contrary, the speed of the air flows in the wind tunnels 23, 31 and 38 can be selected in such a way that the extent of friction between the filaments of the running web and the surrounding air is zero, or that the air flows 24, 32, 39 actually assist the driven rollers 9, 11 and/or 13, 14 and/or 17, 18 and/or 22 in advancing the filaments at an optimum speed. This, in turn, ensures that the stretching, relaxing, plasticizing and gathering of the tow 1 in the respective portions 3, 6, 4, 7 of the elongated path can be carried out in a highly predictable (optimum) manner.

Moreover, the air streams 24, 32 and/or 39 can serve as a means for evacuating loose or loosened filaments from the path for the tow 1. In addition, such air streams can evacuate particles of dust and/or fragmentized filaments. This contributes to the acceptability of the environment in which the production line including the apparatus of FIGS. 1 to 3 is being put to use.

The wind tunnel 31 in the portion 6 of the path for the tow 1 exhibits the additional important advantage that it ensures a highly desirable, predictable and optimum guidance of filaments between the driven rollers 13, 14 and the in let of the plasticizing means 19.

The utilization of wind tunnels 23, 31 and 38 has been found to contribute to the development of laminar air flows at the side(s) of the web advancing along the respective portions of its path, i.e., the surrounding air is prevented from developing eddies, vortices and/or other disturbances which could interfere with the advancement and/or treatment of filaments in the respective portions of the path.

The improved method and apparatus are effective and desirable at all speeds of the treated tow, including high or extremely high speeds at which, in the absence of induced air flows in the direction indicated by the arrows 2, bodies of air adjacent the portions of the running web would be highly likely to interfere with optimum or required stretching, relaxing and/or gathering due to the development of pronounced friction between the running web and the adjacent stagnant bodies of air.

It has been found that the novel method and the improved apparatus contribute to the predictability of treatment of the tow and hence to the making of superior filter rods and filter rod sections.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making filter mouthpieces and, therefore, such adaptations should and are intended to be comprehended within the meaning and range of equivalence of the appended claims.

What is claimed is:

1. A method for converting a tow of stretchable filamentary filter material for tobacco smoke into a filter rod, comprising the steps of:

advancing a continuous tow of filamentary material from an upstream end toward a downstream end along an elongated path;

stretching the filaments of the advancing tow in a first portion of said path;

contacting the stretched filaments of the advancing tow with a plasticizer in a second portion of said path;

thereupon gathering the advancing tow in a third portion of said path; and subjecting the advancing tow to the action of a gaseous fluid in at least one of said portions of said path, including conveying the fluid in a direction starting from an upstream end toward a downstream end.

2. The method of claim 1, wherein said stretching step includes converting the tow into a relatively flat and relatively wide web of filamentary material and said contacting step comprises spraying the plasticizer onto the web, said gathering step including reducing the width of the web downstream of said second portion of said path as seen in said direction.

3. The method of claim 1, wherein the gaseous fluid is air.

4. The method of claim 1, wherein said advancing step comprises advancing the tow at a first speed at least in said at least one portion of said path and said subjecting step comprises conveying the fluid in said direction at a second speed at second least approximating said first speed.

5. The method of claim 1, wherein said advancing step comprises advancing the tow at a first speed at least in said at least one portion of said path and said subjecting step comprises conveying the fluid in said direction at a second speed at least matching said first speed.

6. The method of claim 1, wherein said stretching step includes converting the tow into a relatively flat and relatively wide web having a first side and a second side, said conveying step including contacting the sides of the web with discrete flows of gaseous fluid in said at least one portion of said path.

7. The method of claim 1, wherein said at least one portion is said first portion of said path.

8. The method of claim 1, wherein said at least one portion is said third portion of said path.

9. The method of claim 1, wherein said at least one portion of said path has an upstream end and a downstream end, as seen in said direction, said conveying step including drawing the gaseous fluid from the upstream end toward the downstream end of said at least one portion of said path.

10. The method of claim 1, wherein said stretching step includes converting the tow into a relatively flat web having a first side and a second side, and further comprising the step of relaxing the stretching of the web in a fourth portion between said first and second portions of said path, said conveying step including contacting one side of the web with gaseous fluid in said fourth portion of said path.

11. Apparatus for converting a tow of stretchable filamentary filter material for tobacco smoke into a filter rod, comprising:

means for advancing a continuous tow of filamentary filter material from an upstream end toward a downstream end along an elongated path;

means for stretching the filaments of the advancing tow in a first portion of said path;

means for contacting the advancing tow of stretched filamentary filter material with a plasticizer in a second portion of said path downstream of said first portion;

means for thereupon gathering the advancing tow in a third portion of said path; and means for subjecting the tow to the action of a flowing gaseous fluid in at least one of said portions of said path, including means for inducing the flow of gaseous fluid in a direction starting from an upstream end toward a downstream end.

12. The apparatus of claim 11, wherein said stretching means includes means for converting the tow into a relatively flat and relatively wide web of filamentary filter material and said contacting means includes means for spraying plasticizer onto said web, said gathering means including means for reducing the width of the web downstream of said second portion of said path, as seen in said direction.

13. The apparatus of claim 11, wherein the gaseous fluid is air.

14. The apparatus of claim 11, wherein said means for subjecting the tow to the action of a flowing gaseous fluid further includes a wind tunnel at least partially surrounding the tow in said at least one portion of said path.

15. The apparatus of claim 14, wherein said wind tunnel has an upstream end and a downstream end, as seen in said direction, said flow inducing means including means for drawing gaseous fluid from said upstream end toward said downstream end of said wind tunnel.

16. The apparatus of claim 15, wherein said advancing means includes means for conveying the tow at a first speed, at least in said at least one portion of said path, said means for drawing gaseous fluid including means for imparting to the gaseous fluid a second speed at least approximating said speed.

17. The apparatus of claim 15, wherein said advancing means includes means for conveying the tow at a first speed, at least in said at least one portion of said path, said means for drawing gaseous fluid including means for imparting to the gaseous fluid a second speed at least matching said first speed.

18. The apparatus of claim 14, wherein said stretching means includes means for converting the tow into a web having a first side and a second side, said wind tunnel having first and second sections adjacent the respective sides of the web in said at least one portion of said path and each of said sections having an upstream end and a downstream end, as seen in said direction, said flow inducing means including suction generating means connected to the downstream ends of said sections of said wind tunnel.

19. The apparatus of claim 14, wherein said at least one portion is said first portion of said path, and said wind tunnel has spaced apart upstream and downstream ends, as seen in said direction, said flow inducing means including suction generating means connected to the downstream end of said wind tunnel.

20. The apparatus of claim 14, wherein said at least one portion is said third portion of said path and said wind tunnel has spaced apart upstream and downstream ends, as seen in said direction, said flow inducing means including suction generating means connected to said downstream end of said wind tunnel.

21. The apparatus of claim 14, wherein said means for subjecting the tow to the action of a flowing gaseous fluid further comprises adjusting means for varying the rate of fluid flow through said wind tunnel.

22. The apparatus of claim 14, wherein said wind tunnel has walls at least partially surrounding said at least one portion of said path and at least one of said walls is adjustable substantially transversely of said direction to thus vary the rate of fluid flow through said wind tunnel.

23. The apparatus of claim 14, wherein said wind tunnel has spaced apart intake and discharge ends, as seen in said direction, and said discharge end is arranged to reverse the direction of flow of fluid flowing from from said at least one portion of said path.

24. The apparatus of claim 23, wherein said at least one portion is said first portion of said path.

25. The apparatus of claim 11, further comprising means for relaxing the stretching of filamentary filter material of the tow in a fourth portion between said first and second portions of said path.

26. The apparatus of claim 25, wherein said means for subjecting the tow to the action of a flowing gaseous fluid further includes a wind tunnel at least partially surrounding the stretched filaments of the tow in said fourth portion of said path and having spaced-apart upstream and downstream ends, as seen in said direction, said flow inducing means including means for admitting compressed gaseous fluid into said wind tunnel at said upstream end and a suction generating device connected to the wind tunnel at said downstream end thereof.

* * * * *